US007990036B2

(12) United States Patent
Verspaget

(10) Patent No.: US 7,990,036 B2
(45) Date of Patent: Aug. 2, 2011

(54) ELECTRIC LAMP FEATURING A DISCHARGE VESSEL WITH PINCHED SEALS AND MOUNTING MEMBERS

(75) Inventor: Godefridus Nicolaas Maria Verspaget, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 288 days.

(21) Appl. No.: 11/909,627

(22) PCT Filed: Mar. 28, 2006

(86) PCT No.: PCT/IB2006/050932

§ 371 (c)(1),
(2), (4) Date: Sep. 25, 2007

(87) PCT Pub. No.: WO2006/103622

PCT Pub. Date: Oct. 5, 2006

(65) Prior Publication Data

US 2008/0197761 A1 Aug. 21, 2008

(30) Foreign Application Priority Data

Mar. 31, 2005 (EP) ..... 05102538
May 2, 2005 (EP) ..... 05103615

(51) Int. Cl.
*H01J 5/48* (2006.01)
*F21V 21/00* (2006.01)
*F21V 21/088* (2006.01)

(52) U.S. Cl. ..... 313/318.07; 313/318.09; 313/318.1; 362/217.16

(58) Field of Classification Search ..... 313/318.02, 313/25, 634, 318.05, 318.07, 318.09, 318.11, 313/318.1, 49–51, 252, 292, 623–625; 439/180, 439/226–244; 362/217.12, 217.13, 217.16, 362/217.17, 288, 306, 396, 439, 443, 457
See application file for complete search history.

(56) References Cited

U.S. PATENT DOCUMENTS 2,802,961 A * 8/1957 Jenne, Jr. ..... 313/25
4,879,491 A * 11/1989 Hirozumi et al. ..... 313/318.1
4,897,491 A * 1/1990 Kawasaki et al. ..... 548/336.5
5,128,588 A * 7/1992 Kameya et al. ..... 313/623
5,146,134 A * 9/1992 Stadler et al. ..... 313/579
5,339,001 A 8/1994 King et al.
5,594,295 A * 1/1997 Van Gennip et al. ..... 313/25
5,818,154 A * 10/1998 Helbig et al. ..... 313/318.01
5,905,338 A * 5/1999 Verspaget et al. ..... 313/623

(Continued)

FOREIGN PATENT DOCUMENTS

EP 407850 A1 1/1991
EP 0540019 A1 5/1993
EP 664555 7/1995

OTHER PUBLICATIONS

Roylance, Stress-Strain Curves, Aug. 23, 2001, retrieved Dec. 2, 2010 from Internet Archive Wayback Machine,archive dated May 12, 2004.*

Internet Archive Wayback Machine, retrieved Dec. 2, 2010, archive of Stress-Strain Curves.*

*Primary Examiner* — Nimeshkumar D Patel
*Assistant Examiner* — Steven Horikoshi

(57) ABSTRACT

The electric lamp comprises a discharge vessel (1) which has pinched seals (4) of H-shaped cross-section. A pair of metal mounting members (10) are clicked on each pinched seal (4) to allow the lamp to be mounted in a tubular quartz glass sleeve. The lamp may be used to sterilize a liquid which is made to flow past the glass sleeve. The lamp can be easily mounted into and removed from the glass sleeve.

6 Claims, 5 Drawing Sheets

U.S. PATENT DOCUMENTS 5,932,955 A * 8/1999 Berger et al. ..... 313/318.02
2002/0047522 A1* 4/2002 Horiuchi et al. ..... 313/623
2003/0057837 A1* 3/2003 Davey, Jr. ..... 313/634
2005/0029918 A1* 2/2005 Versluijs et al. ..... 313/318.07

* cited by examiner

ELECTRIC LAMP FEATURING A DISCHARGE VESSEL WITH PINCHED SEALS AND MOUNTING MEMBERS

The invention relates to an electric lamp comprising:

a tubular glass discharge vessel having a longitudinal axis, an axial plane P and opposite end portions each having a pinched seal, each pinched seal having two opposed major side faces along plane P and two opposed narrow side faces;

opposite electrodes disposed inside the discharge vessel;

current conductors connected to a respective electrode, emanating from the discharge vessel through a respective pinched seal;

an ionizable gas filling in the discharge vessel; and metal mounting members present on the pinched seals to mount the discharge vessel in a tubular glass sleeve.

An embodiment of the electric lamp described in the opening paragraph is known from EP-A-0 540 019.

In the known lamp, the discharge vessel is mounted in an outer envelope. The metal mounting members are present at transversal end faces of the pinched seals. They are mutually united by a metal rod which runs along the discharge vessel and to which they are welded. The rod supports the discharge vessel in the outer envelope. Strips extend radially from the mounting members to axially support a glass sleeve which surrounds the discharge vessel inside the outer envelope, and have circularly bent bands which envelope the glass sleeve.

The rod unites the discharge vessel and the glass sleeve to constitute a permanent unit.

It is a disadvantage of the known lamp that the discharge vessel is permanently mounted in the glass sleeve and can not be exchanged.

It is an object of the invention to provide an electric lamp of the type described in the opening paragraph, which has a simple construction and can be easily mounted in and removed from a glass sleeve.

This object is realized in that the pinched seals are H-shaped in sections cross to the axis, a pair of mounting members is present on each seal, each mounting member seizing about a narrow side face and engaging the major side faces with a clamping fit, in which each mounting member has axially extending support portions at either side of plane P, which support portions are situated at a distance from the respective major side face.

After the manufacture of the discharge vessel has been completed, the mounted members, approaching the seal radially, are simply clicked into position onto a pinched seal, a connector having a cable is put into position at one end portion of the discharge vessel, and the discharge vessel is slid into a glass sleeve, with the connector in front. When a second connector is positioned, the lamp is suitable for e.g. sterilizing or cleaning a liquid such as e.g. water, which is made to flow past the sleeve. For example, after its life time has elapsed, the lamp can be easily removed from the sleeve, while the sleeve itself remaining in place in the apparatus to which it belongs. In this connection, it is interesting to note that all mounting members are completely inside the sleeve, which is contrary to the situation in the known lamp.

The mounting members serve as gliders to facilitate introduction of the discharge vessel into and removal from the glass sleeve, and as spacers and buffers to keep the discharge vessel itself spaced apart from the sleeve and to buffer vibrations which may occur in the sleeve as a result of liquid flowing past. This buffering function allows the liquid to flow at a higher speed. This is in contrast to lamps having ceramic spacers, which cause the risk of fracture of the sleeve when it is subjected to vibrations. Fracture results in the liquid penetrating the sleeve and thereby causing short circuits.

It is an advantage, that no welding operations need to be carried out to fasten the mounting members onto the pinched seals, such as is the case when a clamping strap is used. It is another advantage, that the mounting members may be mounted, approaching the pinched seal radially in stead of axially, because there is now great freedom of shaping the pinched seal and having extreme portions of the discharge vessel of different size and shape present beyond the pinched seal.

It is also an advantage, that no cement is used to fasten the mounting members, as the case in lamps having ceramic mounting members. During operation of the lamp, cement may lose relatively volatile components which deposit on the glass sleeve, thereby obstructing the emission of radiation.

Although the mounting members may be seated on the pinched seals in a clamping manner only, it is advantageous if the pinched seals have a transversely extending profile and the mounting members cooperate with the profile of the respective pinched seal to counteract axial displacement. Such a profile may e.g. be a recess in the narrow side faces or in the major side faces, or one or more bosses, e.g. on the major side faces.

In an embodiment, each mounting member has a relatively stiff support portion and a relatively resilient support portion. This has the advantage, that the resilient portions urge the relatively stiff portions against the sleeve and thereby cause the discharge vessel to occupy a predetermined radial position in the sleeve. If desired, the discharge vessel may have an eccentric position and its distance to the sleeve may be locally minimized.

For even easier assembly, the mounting members of a pair may mutually be united by means of a bridge. The bridge may have a relatively weak portion which is relatively easily deformed during assembly.

The mounting members may be made of metal sheet, but it is advantageous if the mounting members consist of bent metal wire. This saves much material as compared to members punched from sheet material. When wire is used, no or substantially no material is lost.

Metals which are able to withstand the temperature to which they are subjected during operation of the lamp are selected for use in the mounting member. Generally, said temperature is about 560° C. Examples of suitable metals are nickel-cobalt-chromium steels, such as the steel type known as Inconel 718, which has a nickel-chromium content of 50% by weight and a cobalt content of 17% by weight, balance iron.

In an embodiment, each mounting member keeps an axially directed metal tongue positioned, which extends to beyond the adjacent end portion of the discharge vessel and has a radially hooked end. These tongues may cooperate mechanically with a connector having a cable connected to an electric energy source for feeding the lamp. The tongues ensure that the connectors are kept positioned during manipulation of the lamp.

In a favorable modification of the embodiment in which the mounting members consist of metal wire, an axially directed metal tongue which extends to beyond the adjacent end portion of the discharge vessel and has a radially hooked end, is integral with the mounting member.

In a favorable embodiment, the discharge vessel has a second pinched seal adjacent at least one pinched seal, the current conductor extending in a space between the at least one pinched seal and the second pinched seal having a pleat. As the lamp is operated in the ambient atmosphere of the sleeve, it is favorable that the current conductors are protected against oxidation. In this embodiment, the current conductor extending through the at least one pinched seal is allowed to cool down in said space before emanating from the discharge vessel. To enhance cooling, the space is preferably filled with an inert gas, e.g. nitrogen. Also, the current conductors may be doubled in the space so as to lower their electric resistance. The pleat serves to allow expansion of the current conductors anchored in the adjacent seals, the mutual distance of which hardly changes after ignition of the lamp, due to the low thermal expansion of a glass of high $SiO_2$ content, such as quartz glass, whereas the current conductors have a larger coefficient of linear thermal expansion.

A second pinched seal adjacent only one pinched seal may suffice if the other pinched seal is relatively cold during operation, for instance, because of its position in the apparatus in which the lamp is used. A second pinched seal is preferably present in each end portion.

In its end portions, the discharge vessel may have an open cylindrical extremity. This can be used as a seat for the connector. Moreover, this extremity, which is raised above the level of the major side faces, can serve as a profile of the adjacent pinched seal to prevent axial displacement of the mounting members. The space between the seals and the second seals, may also have this function with its wall.

Embodiments of the electric lamp of the invention will be described and further elucidated with reference to the drawings, in which.

Figure 6:
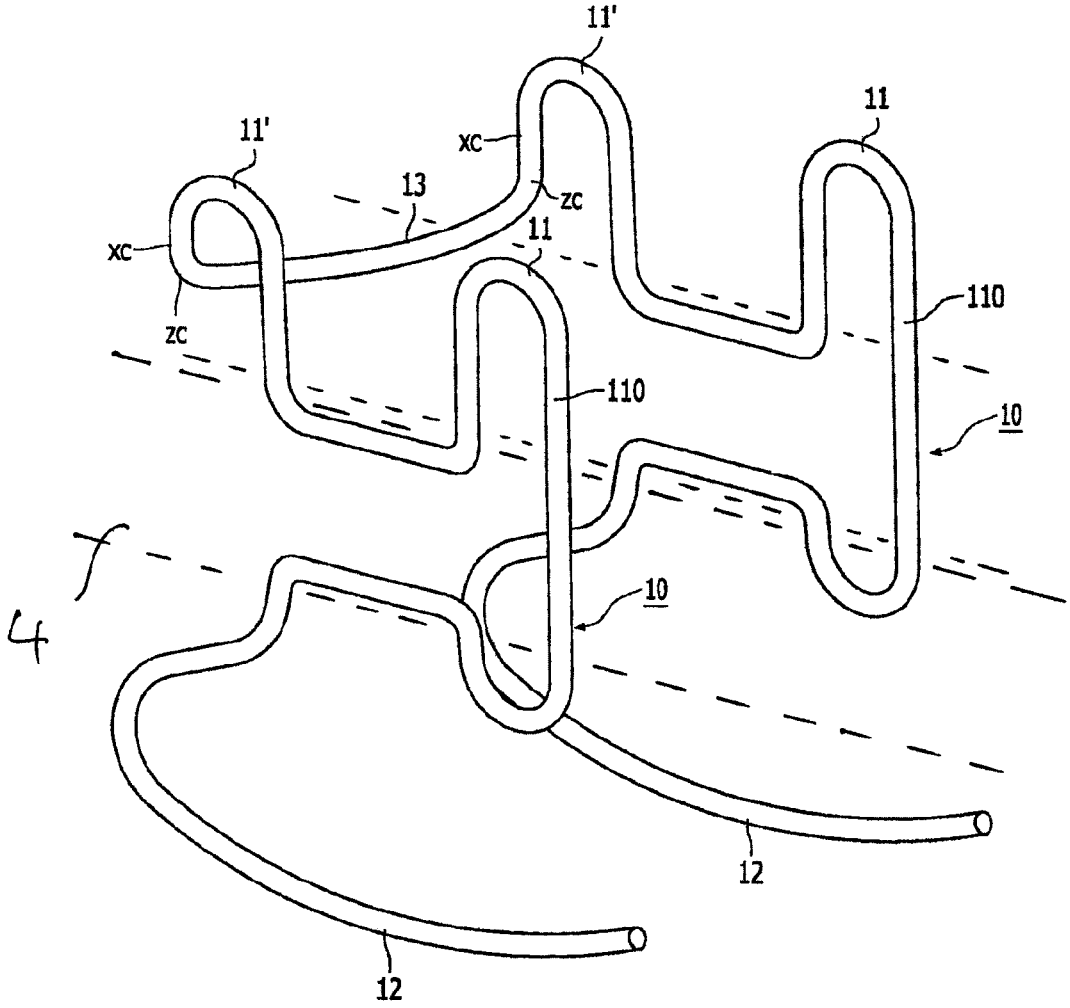
FIG. 6 shows a second embodiment of a mounting member.
Figure 7:
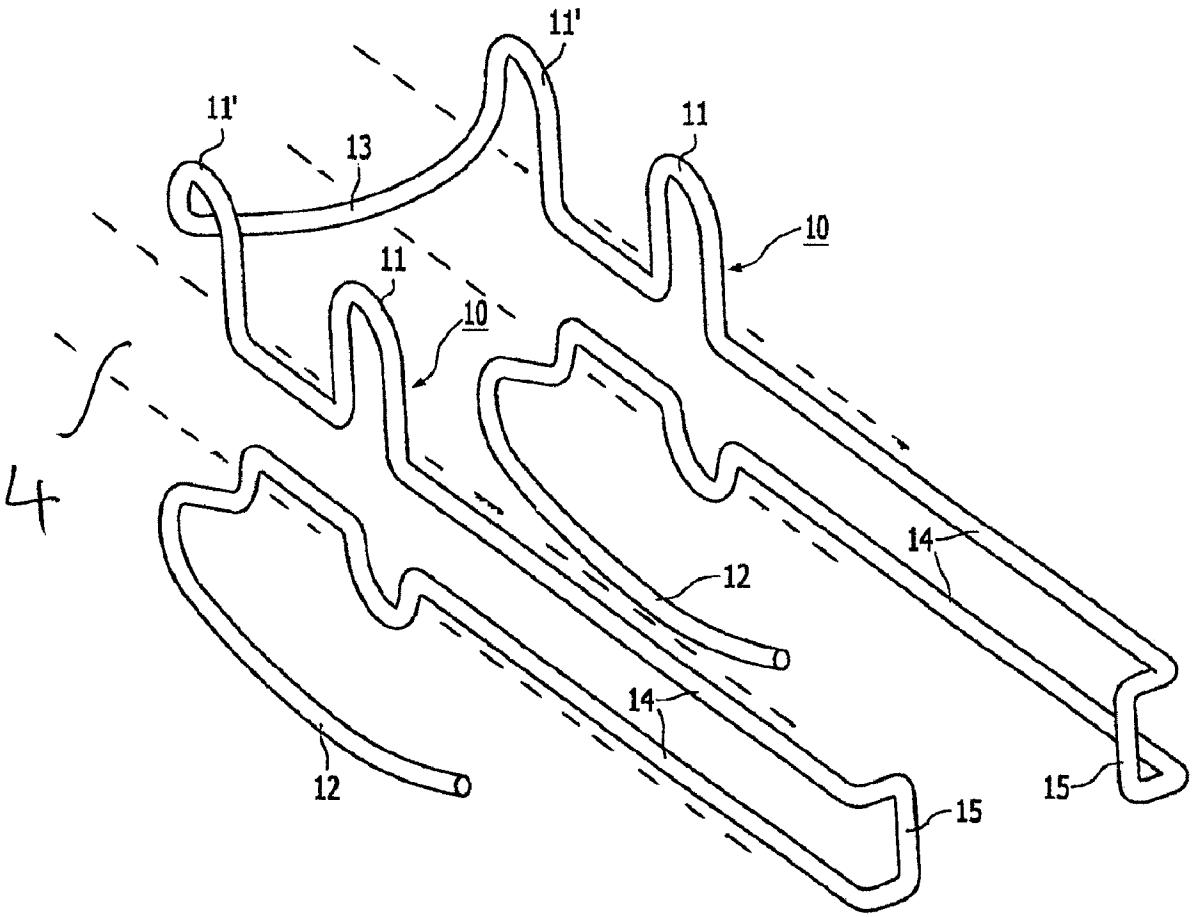

FIG. 7 the mounting member of FIG. 6 provided with axially directed metal tongues.

Figure 1:
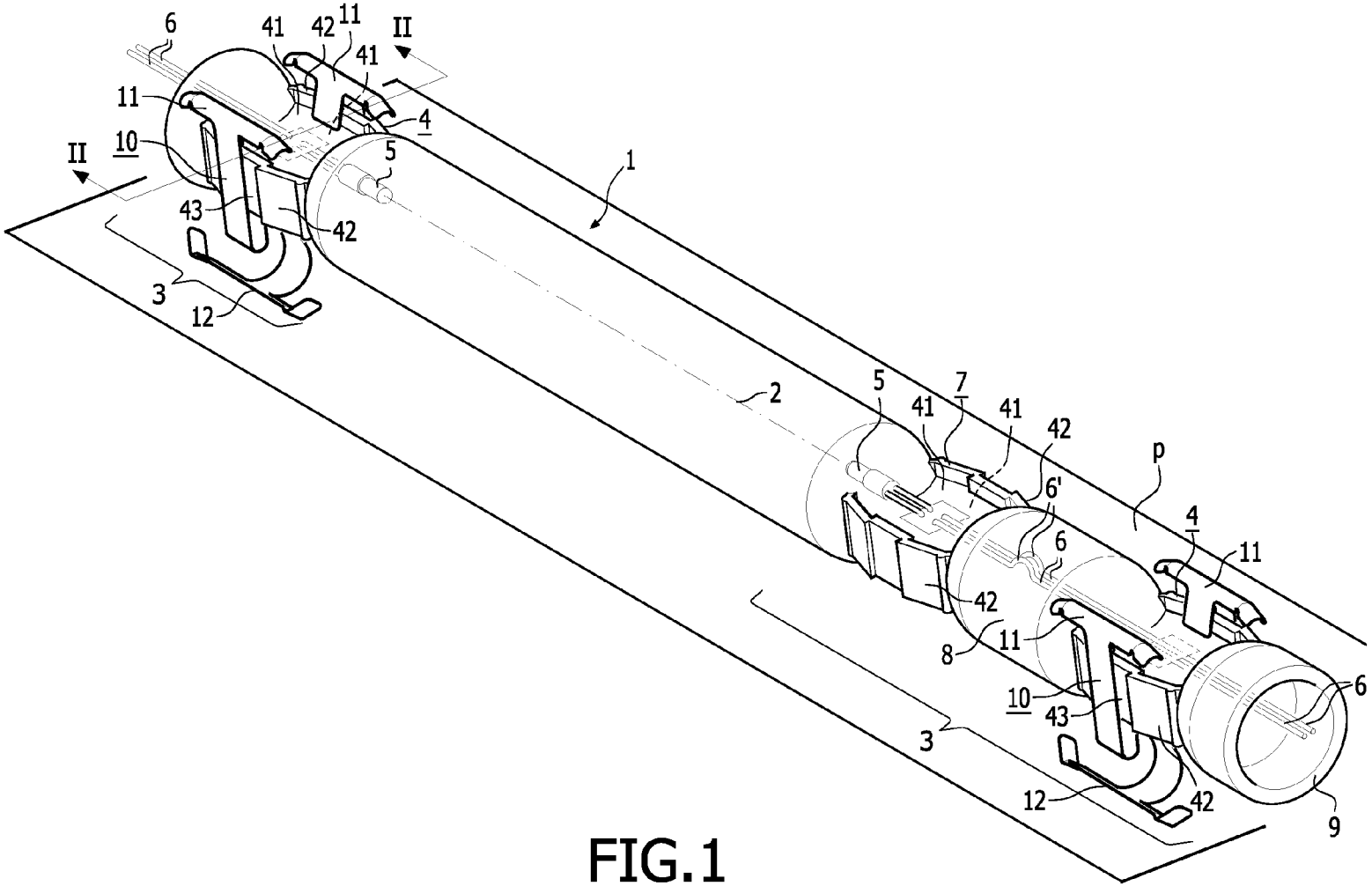
FIG. 1 is a perspective view of a first embodiment.

In FIG. 1, the electric lamp has a tubular quartz glass discharge vessel 1 having a longitudinal axis 2, an axial plane P and opposite end portions 3, each having a pinched seal 4. Each pinched seal 4 has two opposed major side faces 41 along plane P and two opposed narrow side faces 42. Opposite tungsten electrodes 5 are disposed inside the discharge vessel 1. Current conductors 6 connected to a respective electrode 5 emanate from the discharge vessel 1 through a respective pinched seal 4. An ionizable gas filling is present in the discharge vessel 1. In the lamp shown, the filling comprises mercury and an Ar/Kr mixture of 95/5% by volume. The discharge vessel has an overall length of about 61 cm. The lamp has a power consumption of 5.6 kW at a voltage of 1150V. Metal mounting members 10 are present on the pinched seals 4 to mount the discharge vessel 1 in a tubular quartz glass sleeve.

Figure 2:
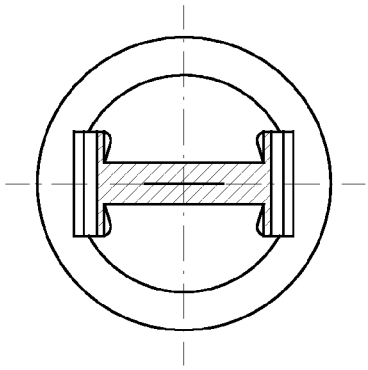
FIG. 2 is the sectional plane of a cross-section through a pinched seal taken on the line II-II in FIG. 1.

The pinched seals 4 are H-shaped in sections cross to the axis 2, as is shown in FIG. 2. A pair of mounting members 10 is present on each seal 4. Each mounting member 10 seizes about a narrow side face 42 and engages the major side faces 41 with a clamping fit. Each mounting member 10 has axially extending support portions 11,12 at either side of plane P, which support portions are at a distance from the respective major side faces 41.

The pinched seals 4 have a transversely extending profile 43 and the mounting members 10 cooperate with the profile 43 of the respective pinched seals 4 to counteract axial displacement. In the Figure, a recess in the narrow side faces 42 constitutes the transversely extending profile 43.

Figure 3:
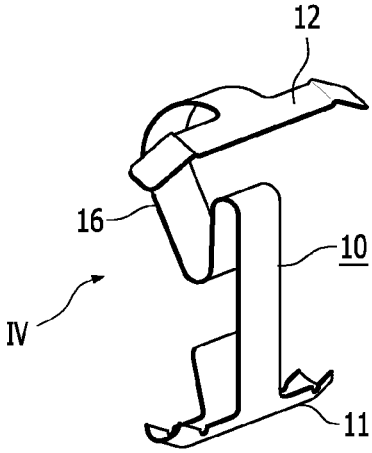
FIG. 3 shows a mounting member as used in FIG. 1 in a perspective view.
Figure 4:
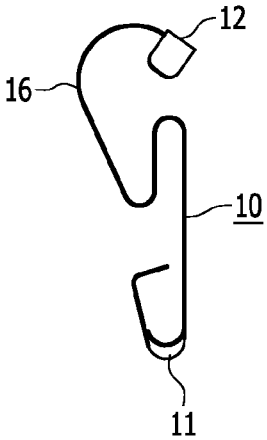
FIG. 4 shows the mounting member of FIG. 3 in a side elevation taken on the line IV in FIG. 3.

Each mounting member 10, cf. FIGS. 3 and 4, has a relatively stiff support portion 11 and a relatively resilient support portion 12, which in the Figures is at the end of a relatively long, smoothly bent portion 16. To facilitate introduction of the lamp into a glass sleeve, the ends of the support portion 11 and the ends of the support portion 12 are bent to one another.

Figure 5:
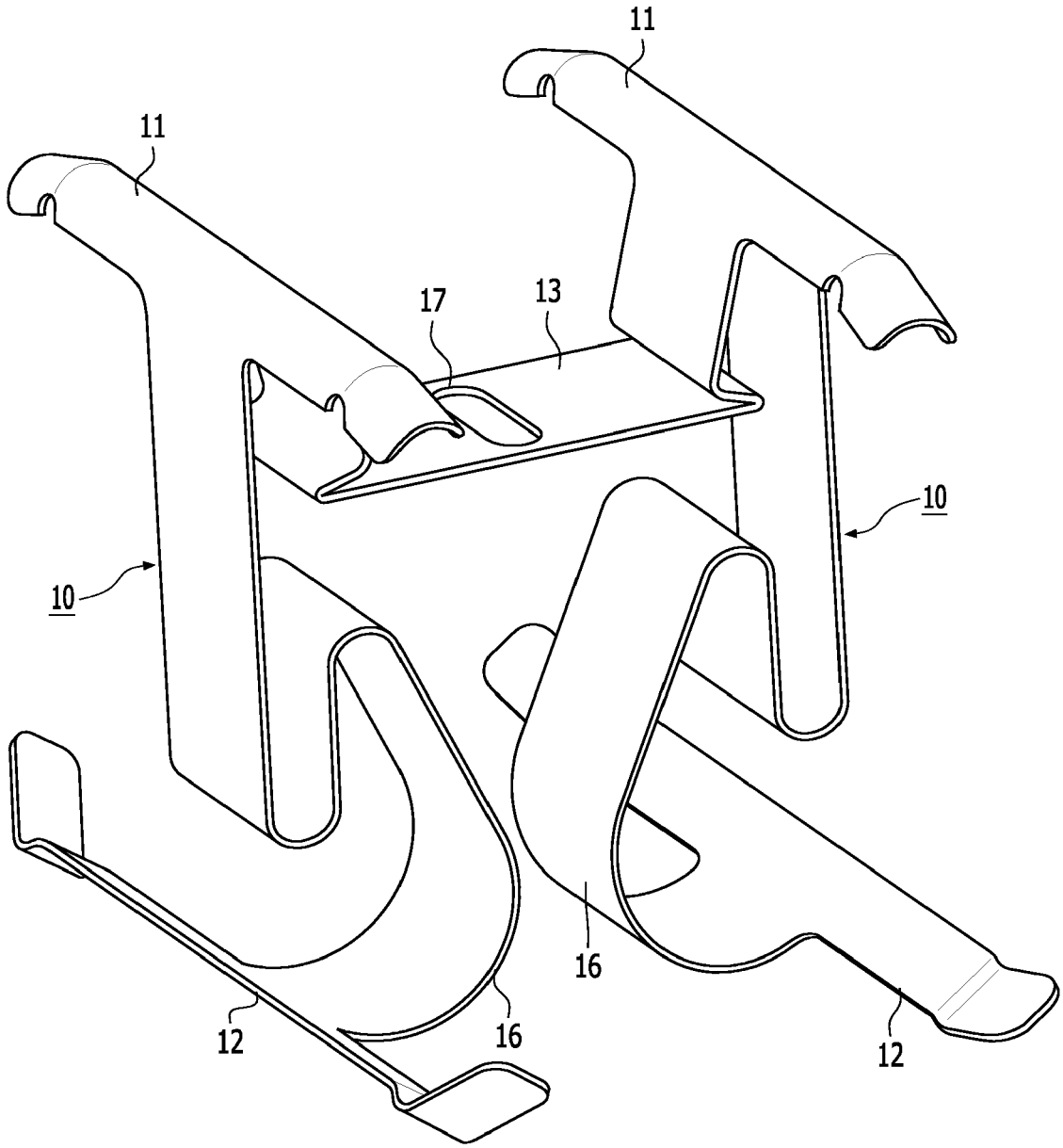
FIG. 5 shows the mounting member of FIGS. 3 and 4 united by a bridge with a second mounting member in a perspective view.

In FIG. 5, the mounting members 10 of a pair are mutually united by means of a bridge 13. The bridge 13 has a weakened portion 17 to facilitate the assembly. The Figure shows that the mounting members 10 of the pair are each other's mirror image. This has the effect that the support portions 12 will minimize the distance of the discharge vessel to the sleeve adjacent support portions 11. However, a centered position of the discharge vessel can be achieved with identical mounting members or adjusted dimensions.

In FIG. 7, each mounting member 10 keeps an axially directed metal tongue 14 positioned, which extends to beyond the adjacent end portion 3 of the discharge vessel 1 (of FIG. 1) and has a radially hooked end 15. This metal tongue 14 may be integral with the mounting member 10, but this involves a considerable metal consumption. Otherwise, the tongue may be welded to the mounting member 10 or may even be enclosed by the mounting member 10 and the pinched seal 4, seated in the recess in the narrow side face 42, which constitutes the transversely extending profile 43.

The discharge vessel 1 has a second pinched seal 7 adjacent one pinched seal 4, the current conductor 6 extending in a space 8 between said one pinched seal 4 and the second pinched seal 7 having a pleat 6'. This second pinched seal 7 may also carry mounting members 10, if desired.

The end positions 3 of the discharge vessel 1 shown have an open cylindrical extremity 9. This extremity 9 brings about an elevation with respect to the major side face 41 of the adjacent pinched seal 4, which may be used as a transversely extending profile. Similarly, the wall of the space between the pinched seal 4 and the second pinched seal 7 may constitute a transversely extending profile.

In FIG. 6, the mounting member 10 consists of bent metal wire.

Mounted onto a pinched seal 4 of the lamp of FIG. 1, the mounting member 10 is axially enclosed by the extremity 9 and the wall of the space 8 by means of the sections zc, zc (of support sections 11'), and bridge portion 13 at one end and section 110 at the other hand end, as illustrated in FIG. 6.

In FIG. 7 the mounting member 10 of bent metal wire includes the axially directed metal tongues 14 with the radially hooked ends 15.

The invention claimed is:

1. An electric lamp comprising:

a tubular glass discharge vessel having a longitudinal axis, an axial plane P and opposite end portions each having a pinched seal, each pinched seal having two opposed major side faces along plane P and two opposed narrow side faces, wherein the end portions of the tubular glass discharge vessel each comprise an open cylindrical extremity for bringing about an elevation with respect to corresponding major side faces of an adjacent pinched seal;

electrodes disposed inside the discharge vessel proximate opposite end portions of the tubular glass discharge vessel;

current conductors connected to a respective electrode, emanating from the discharge vessel through a respective pinched seal proximate opposite end portions of the tubular glass discharge vessel;

an ionizable gas filling in the discharge vessel; and metal mounting members present radially mounted on each of the pinched seals, via approaching a respective pinched seal radially instead of axially, to facilitate introduction of the discharge vessel in into and removal from a tubular glass sleeve, wherein the pinched seals are H-shaped in sections cross to the axis, a pair of the mounting members is presen being radially mounted on each seal, each mounting member of the pair of the mounting members (i) seizing about a narrow side face and engaging the major side faces with a non-welded clamping fit and (ii) having axially extending support portions at either side of plane P, wherein the axially extending support portions are situated at a distance from the respective major side face to serve as gliders to facilitate introduction of the discharge vessel into and removal from a sleeve, further wherein the pinched seals each have transversely extending profiles, the transversely extending profiles further including (i) recesses in the narrow side faces or the major side faces of respective pinched seals or (ii) one or more bosses on the major side faces of respective pinched seals, and wherein the respective mounting members cooperate with the recesses or one or more bosses of the transversely extending profile of the respective pinched seal to counteract axial displacement between a respective corresponding pinched seal and mounting member, wherein each mounting member keeps an axially directed metal tongue positioned, which extends to beyond the adjacent end portion of the discharge vessel and has a radially hooked end.

2. The electric lamp as claimed in claim 1, wherein each mounting member has a relatively stiff support portion and a relatively resilient support portion.

3. The electric lamp as claimed in claim 2, wherein the mounting members of a pair are mutually united by means of a bridge.

4. The electric lamp as claimed in claim 1, wherein the discharge vessel has a second pinched seal adjacent at least one pinched seal, the current conductor extending in a space between the at least one pinched seal and the second pinched seal having a pleat.

5. The electric lamp as claimed in claim 1, further wherein the axially extending support portions of each mounting member are situated at the distance from the respective major side face to serve as spacers and buffers to maintain the discharge vessel itself spaced apart from the sleeve and to buffer vibrations which may occur in the sleeve.

6. An electric lamp comprising:

a tubular glass discharge vessel having a longitudinal axis, an axial plane P and opposite end portions each having a pinched seal, each pinched seal having two opposed major side faces along plane P and two opposed narrow side faces, wherein the end portions of the tubular glass discharge vessel each comprise an open cylindrical extremity for bringing about an elevation with respect to corresponding major side faces of an adjacent pinched seal;

electrodes disposed inside the discharge vessel proximate opposite end portions of the tubular glass discharge vessel;

current conductors connected to a respective electrode, emanating from the discharge vessel through a respective pinched seal proximate opposite end portions of the tubular glass discharge vessel;

an ionizable gas filling in the discharge vessel; and metal mounting members present radially mounted on each of the pinched seals, via approaching a respective pinched seal radially instead of axially, to facilitate introduction of the discharge vessel in into and removal from a tubular glass sleeve, wherein the pinched seals are H-shaped in sections cross to the axis, a pair of the mounting members is present being radially mounted on each seal, each mounting member of the pair of the mounting members (i) seizing about a narrow side face and engaging the major side faces with a non-welded clamping fit and (ii) having axially extending support portions at either side of plane P, wherein the axially extending support portions are situated at a distance from the respective major side face to serve as gliders to facilitate introduction of the discharge vessel into and removal from a sleeve, further wherein the pinched seals each have transversely extending profiles, the transversely extending profiles further including (i) recesses in the narrow side faces or the major side faces of respective pinched seals or (ii) one or more bosses on the major side faces of respective pinched seals, and wherein the respective mounting members cooperate with the recesses or one or more bosses of the transversely extending profile of the respective pinched seal to counteract axial displacement between a respective corresponding pinched seal and mounting member, wherein the mounting members consist of bent metal wire.

* * * * *